US008770830B2

(12) United States Patent
Boularas

(10) Patent No.: US 8,770,830 B2
(45) Date of Patent: Jul. 8, 2014

(54) WATCH STRAP OR BRACELET

(75) Inventor: Maamar Boularas, Boudry (CH)

(73) Assignee: The Swatch Group Management Services AG, Bienne (CH)

( * ) Notice: Subject to any disclaimer, the term of this patent is extended or adjusted under 35 U.S.C. 154(b) by 851 days.

(21) Appl. No.: 12/936,300

(22) PCT Filed: Apr. 2, 2009

(86) PCT No.: PCT/EP2009/053949
§ 371 (c)(1),
(2), (4) Date: Dec. 29, 2010

(87) PCT Pub. No.: WO2009/121928
PCT Pub. Date: Oct. 8, 2009

(65) Prior Publication Data

US 2011/0103198 A1 May 5, 2011

(30) Foreign Application Priority Data

Apr. 2, 2008 (CH) ..... 496/08

(51) Int. Cl.
*A44B 1/04* (2006.01)
*A44C 5/14* (2006.01)

(52) U.S. Cl.
USPC ..... 368/282; 24/71 J; 24/265 WS; 224/176

(58) Field of Classification Search
USPC ..... 368/281, 282; 24/69 J, 71 R, 71 T, 71 J, 24/265 WS, 265 BC, 265 EC; 224/176
See application file for complete search history.

(56) References Cited

U.S. PATENT DOCUMENTS

| | | | | | |
|---|---|---|---|---|---|
| 5,485,659 | A | * | 1/1996 | Kashikie et al. | 24/71 J |
| 5,699,590 | A | * | 12/1997 | Erard et al. | 24/71 J |
| 5,781,968 | A | * | 7/1998 | Widmer | 24/71 J |
| 5,829,104 | A | * | 11/1998 | Gay et al. | 24/71 J |
| 5,870,803 | A | * | 2/1999 | Jorst | 24/265 WS |

FOREIGN PATENT DOCUMENTS

| | | | |
|---|---|---|---|
| CH | 665 536 | A5 | 5/1988 |
| DE | 201 03 162 | U1 | 6/2001 |
| EP | 0 319 461 | A | 6/1989 |
| EP | 0 775 455 | A | 5/1997 |
| EP | 0 867 968 | A | 9/1998 |
| EP | 1 201 149 | A | 5/2002 |
| FR | 2 699 796 | A | 7/1994 |
| WO | 96/31138 | A | 10/1996 |

OTHER PUBLICATIONS

International Search Report issued in corresponding application No. PCT/EP2009/053949, completed Jun. 17, 2009 and mailed Jul. 1, 2009.

* cited by examiner

*Primary Examiner* — Vit W Miska
(74) *Attorney, Agent, or Firm* — Griffin & Szipl, P.C.

(57) ABSTRACT

The invention concerns a strap or bracelet (1) including a first strand (2) and a second strand (3). The second strand (3) is connected to a clasp (1*a*) that includes a fastening device (13). The fastening device (13) joins the strands (2, 3) to each other. The invention is characterized in that the clasp (1*a*) further includes a safety device (17) for better joining the first strand (2) to the clasp (1*a*) by pressing the former onto the latter.

16 Claims, 4 Drawing Sheets

WATCH STRAP OR BRACELET

This is a National Phase Application in the United States of International Patent Application PCT/EP2009/053949 filed Apr. 2, 2009, which claims priority on Swiss Patent Application No. 00496/08 of Apr. 2, 2008. The entire disclosures of the above patent applications are hereby incorporated by reference.

The invention concerns a strap or bracelet including a first strand and a second strand. The second strand is connected to a clasp that includes a fastening device. The fastening device joins said strands to each other.

BACKGROUND OF THE INVENTION

Clasps for straps or bracelets that use a buckle and tongue to join the two strands of the strap or bracelet to each other are known from the prior art. The strap or bracelet includes a first strand with said buckle and tongue and a second strand wherein holes are made. The second strand is intended for removable attachment to said first strand by engagement in the buckle. The buckle includes two lateral arms, each provided with a hole, a removable crosspiece whose ends are arranged to engage in the holes in the arms, and a tongue with an eye part rotatably engaged on said bar. The first strand has a transversely arranged end orifice close to a free end of the strand, for receiving said buckle bar, and an end notch that extends from said free end to beyond the end hole for receiving the eye part of the tongue. In fact, when the second strand is engaged in the buckle, the two strands are joined by the engagement of the tongue in one of the holes in the second strand. Thus, depending upon the hole in which the tongue is engaged, the second bracelet strand is engaged closer or further away in the buckle, tightening said bracelet to a greater or lesser degree.

However, one of the problems of this buckle of the prior art is that the second bracelet strand, which is engaged in the buckle, also passes through leather rings located on the bracelet strand to which the buckle is secured, so as to press the second strand onto the first strand. It is possible, when the bracelet is being worn, for stresses applied to the second strand to be such that said strand comes out of the leather rings, which may lead to the bracelet opening.

SUMMARY OF THE INVENTION

The invention concerns a strap or bracelet that overcomes the aforementioned drawbacks of the prior art by proposing a bracelet with a clasp that allows the bracelet to be securely locked.

The invention therefore concerns the aforecited bracelet which is characterized in that said clasp further includes a safety device for better joining the first strand to the clasp by pressing the former onto the latter and in that the clasp is of the type with an unfolding buckle, which means that there is no need to act on the fastening and safety devices to remove the bracelet.

Advantageous embodiments of this watch form the subject of the dependent claims 2 to 14.

One advantage of the bracelet defined in the present invention is, firstly, that the clasp is securely locked. The present invention associates a conventional buckle and tongue with a safety device. This device will press the bracelet strand engaged in the clasp against said clasp such that the strand engaged in the buckle can no longer move longitudinally. This prevents any inadvertent opening of the bracelet from occurring and the bracelet therefore remains adjusted to a constant size until the safety device is unlocked.

Another advantage of the present invention is perceived when the clasp is connected to the second strand via an unfolding buckle controlled by a push-button system. In this case, the safety device acts like a crown protection device, which protects the push-buttons of the buckle from any shocks that may occur.

Finally, the invention concerns the exterior of a timepiece including the bracelet according to the present invention.

BRIEF DESCRIPTION OF THE DRAWINGS

The objects, advantages and features of the watch according to the present invention will appear more clearly in the following detailed description of at least one embodiment of the invention given solely by way of non-limiting example and illustrated by the annexed drawings, in which.

DETAILED DESCRIPTION

In the following description, all those parts of the bracelet that are well known to those skilled in the art in this technical field will be explained only in a simplified manner.

Figure 1:
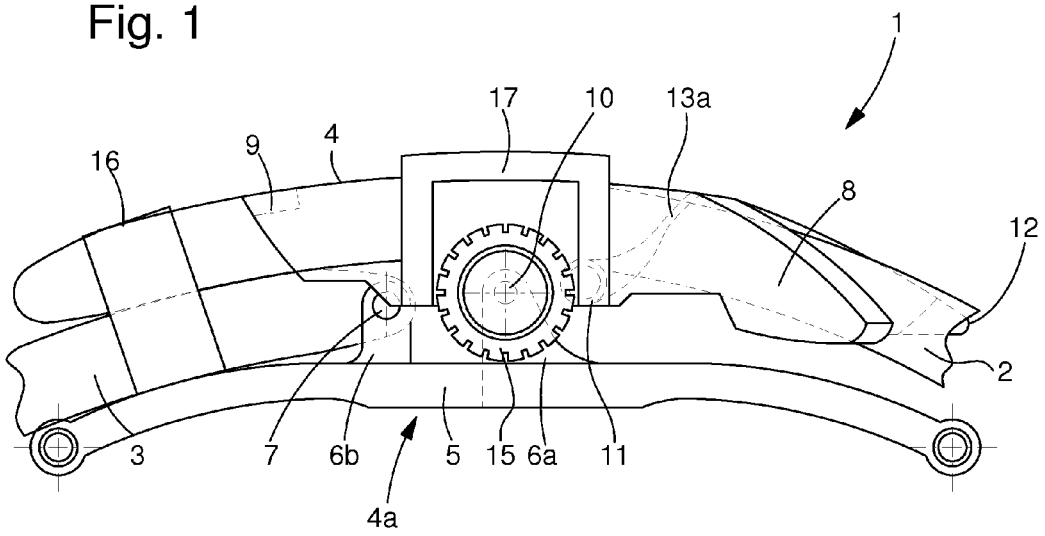
FIG. 1 shows schematically the bracelet according to the present invention.
Figure 3:
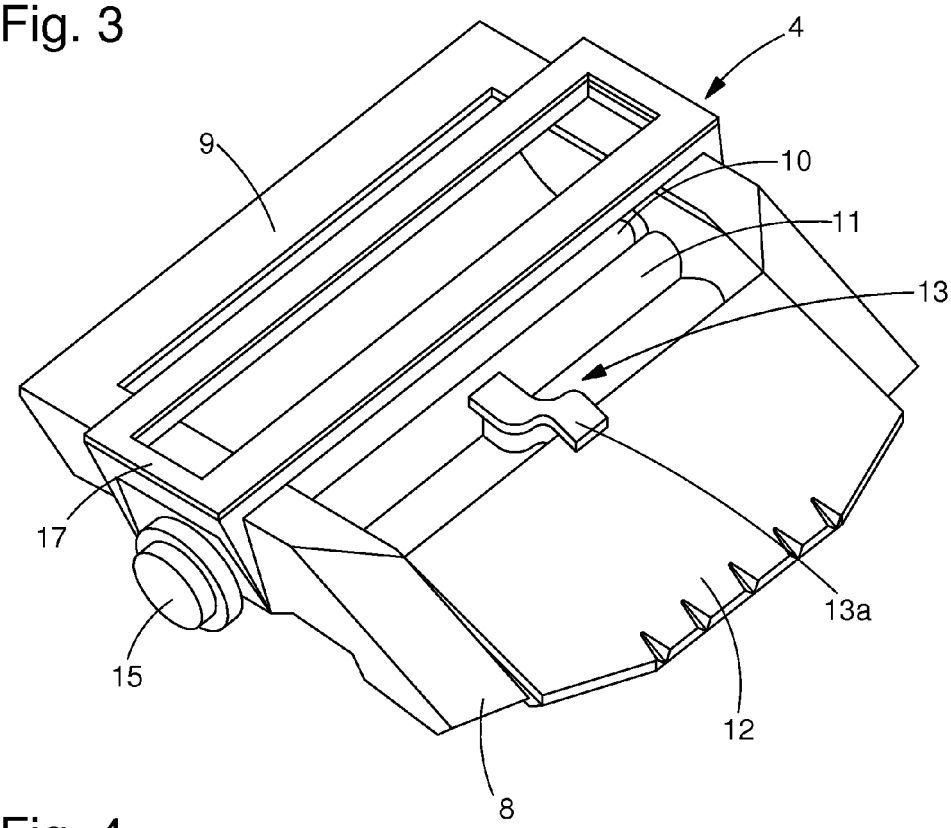
FIG. 3 shows schematically a perspective view of the clasp buckle.

FIG. 1 shows a particular embodiment of bracelet 1 according to the present invention. This bracelet 1 has first 2 and second 3 bracelet strands intended to be removably attached via a clasp 1*a*. Clasp 1*a*, shown in FIG. 3, includes a support 4 and an unfolding buckle 4*a*. Unfolding buckle 4*a* includes a base 5 at the ends of which are pivotably mounted two side portions 6*a*, 6*b*, which are preferably of similar length. This base 5 further includes male fastening members whose purpose is to cooperate with a female fastening member located on side portions 6*a*, 6*b*. This allows unfolding buckle 4*a* to be closed and locked while tightening bracelet 1.

The first side portion 6*a* of unfolding buckle 4*a* is also pivotably mounted on support 4, whereas the second side portion 6*b* is pivotably mounted on second strand 3. Second side portion 6*b* can be mounted on second strand 3 via a pin 7.

Figure 2:
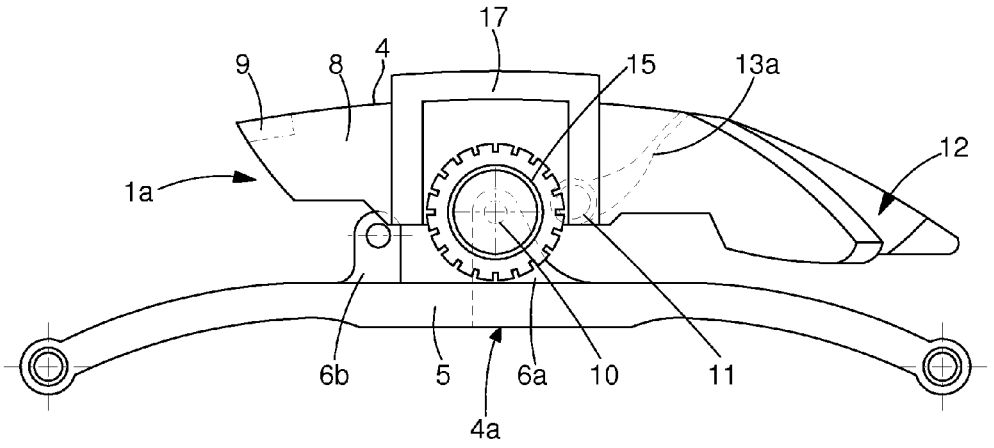
FIG. 2 shows a partial view of FIG. 1 centred on the clasp.

Indeed, so that bracelet 1 is more comfortable for the person wearing it, unfolding buckle 4 is made to be curved to follow the shape of bracelet 1 or to partly follow the shape of the user's wrist. To achieve this, base 5 of unfolding buckle 4*a* is curved such that, when bracelet 1 is being worn by the user, base 5 wholly or partly matches the shape of the user's wrist. Side portions 6*a*, 6*b* are also curved so that, when unfolding buckle 4*a* is closed, side portions 6*a*, 6*b* can be integrated into or at least match the shape of base 5, as shown in FIGS. 1 and 2.

Support 4 is pivotably mounted on first side portion 6*a* and includes a fastening device 13. Support 4 is thus used to attach bracelet 1 via engagement of first strand 2 in support 4. To achieve this, support 4, shown in FIGS. 3 and 4, takes the form of a generally rectangular buckle in which strand 2 of bracelet 1 is engaged. This buckle 4 is formed of two parallel lateral arms 8, each pierced with a hole. The arms are then arranged to face each other so that an arbour 10 can be arranged transversely thereto. This arbour 10 is for mounting second side portion 6*b* of unfolding buckle 4*a* on which the female fastening member of side portion 6*b* is mounted. Arms 8 are also connected to each other by a crosspiece 9 located at one end of the arms and by a support element 12, located opposite said crosspiece 9. This transverse support element 12 takes the form of a plate and is used for cooperating with fastening device 13 of clasp 1*a*.

The function of buckle 4*a*, apart from closing bracelet 1, is to act as guide means. Indeed, first strand 2 engages in buckle 4 to be removably attached to second strand 3? via a fastening device 13. When engaging in buckle 4, first strand 2 is inserted between the two lateral arms 8 of buckle 4 as shown in FIGS. 1 and 4, with the result that the transverse movements of first strand 2 in the buckle are limited by these two arms 8.

Fastening device 13 attaches first strand 2 to buckle 4 and here includes a tongue 13*a*. In fact, tongue 13*a* is a pin, pivotably mounted via an arbour 11 mounted between the two lateral arms 8 of buckle 4. This tongue 13*a* abuts support element 12 and is used for joining the two strands 2, 3 to each other, while allowing the size of bracelet 1 to be selected. To achieve this, holes 14 are arranged in first strand 2 which engages in buckle 4. Thus, when first strand 2 engages in buckle 4, tongue 13*a* can be inserted in one of holes 14, thus blocking strand 2 in buckle 4. Of course, it will be clear that tongue 13*a* may take other forms such as a finger arranged directly on support element 12.

Figure 4:
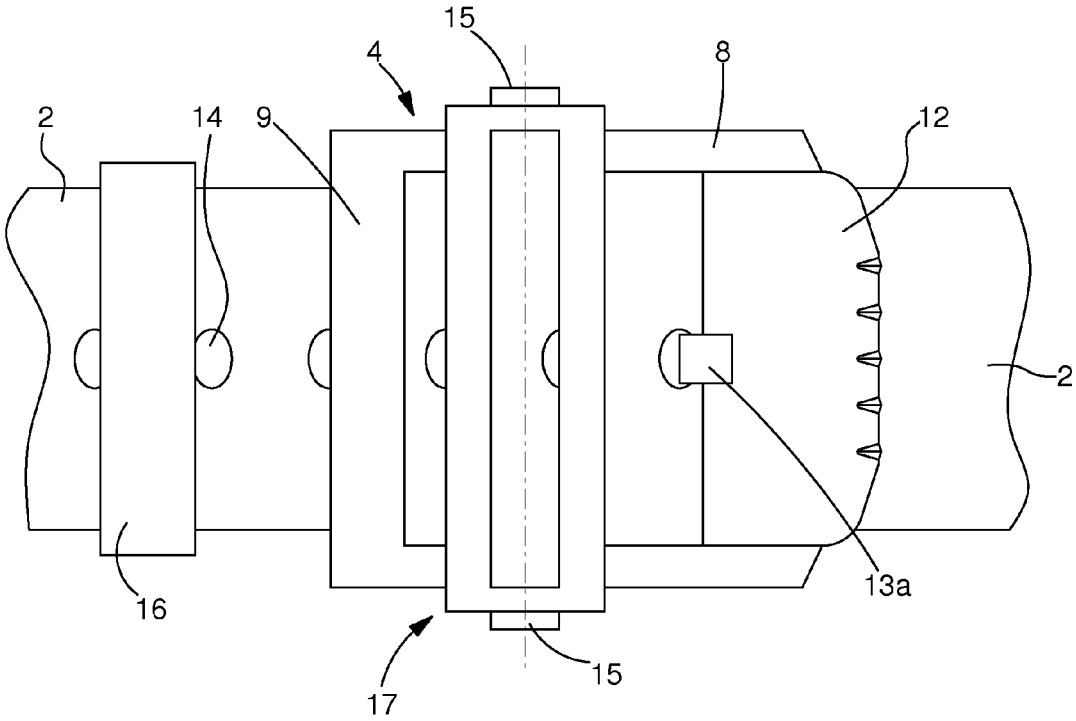
FIG. 4 shows a top view of the buckle of the locked bracelet.

For the assembly of first strand 2 in buckle 4, said strand 2 is engaged in buckle 4 as shown in FIG. 4. Preferably, strand 2 is engaged by entering buckle 4 on the side where support element 12 is located. Of course, the position of buckle 4 could be reversed. Afterwards, bracelet strand 2 will rest on arbours 10, 11 where first side portion 6*a* and tongue 13*a* are pivotably mounted, then emerge on the side of crosspiece 9. Once strand 2 is engaged, it need only be attached to buckle 4. To achieve this, strand 2 is moved longitudinally such that one of holes 14 in said strand 2 is placed in proximity to tongue 13*a* so that the tongue engages therein, thus longitudinally locking first strand 2.

Next, to tighten bracelet 1, and to enable the user to wear said bracelet, unfolding buckle 4 must be closed. To achieve this, the two side portions 6*a*, 6*b* are folded down towards base 5 such that the female locking members of side portions 6*a*, 6*b* cooperate with the male locking members of base 5. Of course, engagement of the female locking members in the male locking members can be achieved using different systems. Indeed, it is possible to use means that operate by pressure or by using push-buttons 15 acting on hooks that grip the male locking members of base 5. Evidently, each side portion 6*a*, 6*b* could also have a different system, for example using pressure on one portion and push-buttons 15 on the other.

Generally, the second bracelet strand 3 has a ring 16 made of leather, or another material, fixed to said bracelet strand 3 close to the end thereof. This ring 16 is arranged so that the end of first strand 2 can be engaged in said ring 16, allowing the two strands 2, 3 to be pressed against each other as efficiently as possible. Moreover, bracelet clasp 1*a* according to the present invention can be provided with additional elements. For example, support 4 can be fitted with additional guide means to further limit the movements of first strand 2 when it is engaged in said support 4. This additional guide means can take the form of one or more eyes located at one or both ends of support 4. The eyes have an opening allowing just enough space for the first strand 2 to be able to engage therein. Thus, the eyes limit the movements of said strand 2, by limiting the clearance of said strand. Preferably, this additional guide means is located in proximity to crosspiece 9. However, the guide means and leather ring 16 are not infallible, and, under some stress, it may happen that first strand 2 of bracelet 1 becomes so loose that it causes bracelet 1 to open.

To avoid this happening, support 4 is provided with a safety device 17 for preventing this type of nuisance. Safety device 17 takes the form of a part mounted on support 4, as shown in FIGS. 1 to 4, and it is generally made of the same material as the support. This device 17 is then temporarily attached inside said support 4 so as to clamp first strand 2 tightly. This therefore presses said strand 2 preventing any clearance against clasp 1*a* and thus limits the movements of said strand 2 still further.

Advantageously, according to the invention, it is thus clear that safety device 17 does not need to be opened for the timepiece to be put on. Indeed, the use of unfolding buckle 4*a* allows the assembly comprising fastening device 13 and safety device 17 to be fixedly adjusted in accordance with the size of the user's wrist.

Figure 5:
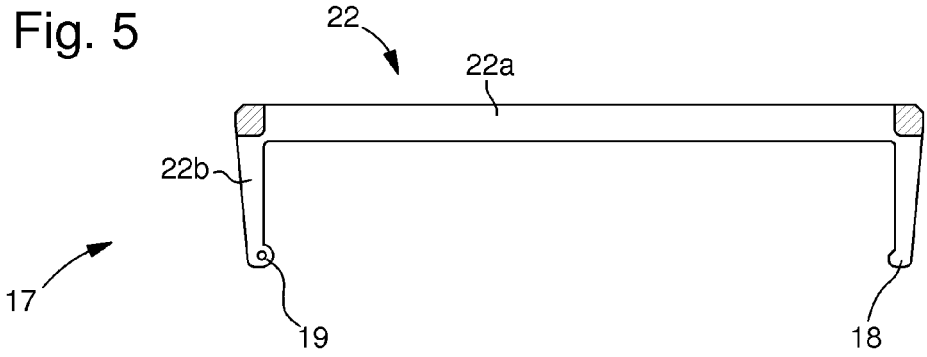
FIG. 5 shows a cross-section of the clasp safety device.

In a particular embodiment shown in the Figures, the part 22 used to clamp first strand 2 against the clasp, takes the form of an approximately U-shaped part 22 as shown in FIG. 5. This part 22 includes a generally flat base 22*a*, for clamping the entire width of strand 2 in a uniform manner, at the ends of which are two arms 22*b* mounted at right angles relative to base 22*a*. At the end of one of the two arms 22*b*, perpendicular to base 22*a*, there is a raised portion 18 in the form of a hook. This hook 18 is used for temporarily attaching U-shaped part 22 to said support 4. At a second end of said part 22 an eye 19 is arranged for permanently attaching said U-shaped part 22 to said support 4. This eye is used for rotatably mounting said U-shaped part 22 on the support.

Figure 7:
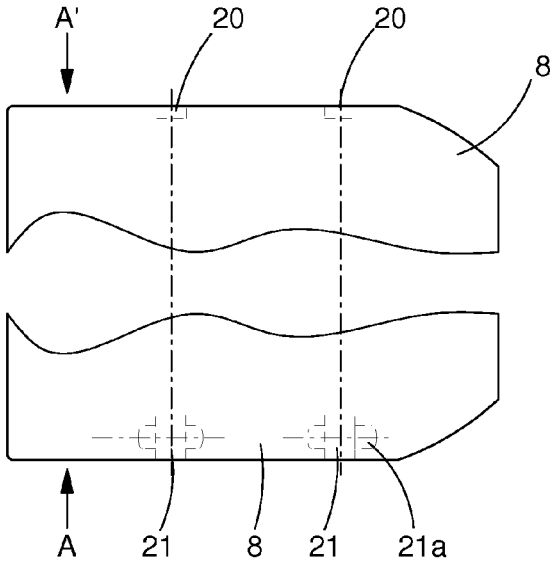
FIG. 7 shows a partial top view of the lateral arms of the clasp.

To assemble said approximately U-shaped part 22 on support 4, one of side arms 8 is provided with means for temporarily attaching part 22 and the other arm 8 is provided with means for permanently attaching said part 22. Thus, on one of arms 8 there is a permanent attachment recess 21 in which eye 19 of U-shaped part 22 is inserted, as shown in FIG. 7. Each flank of this recess is pierced with a hole 21*a* enabling a pin to be inserted therein such that said U-shaped part 22 is pivotably mounted. Whereas the other side arm 8 of the support is provided with a temporary attachment recess 20 located opposite the assembly recess for part 22. When the user wishes to lock clasp 1*a*, he or she will fold part 22 down onto the clasp, thereby clamping first strand 2, and such that hook 18 of part 22 engages in its recess 20.

Of course, it is possible for this attachment to be mounted in a different manner, such as using a slide-block. Moreover, it is possible for the clasp to have several safety devices 17 as described above, and, in such case, several series of recesses 20, 21 are arranged on said support 4.

Figure 6:
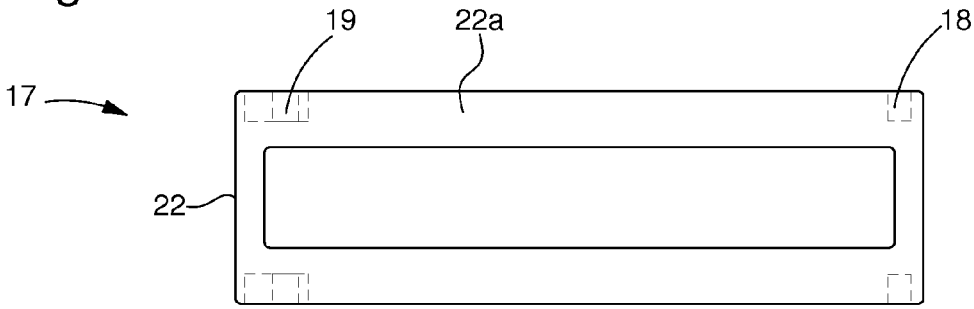
FIG. 6 shows a top view of the clasp safety device according to a preferred variant.

In a preferred variant shown in FIG. 6, safety device 17 may take the form of two U-shaped parts 22 that are integral with each other. This variant has the advantage of increasing the clamping surface and the actual clamping efficiency by distributing stress. Indeed, with a single U-shaped part 22, clamping is optimal when base 22*a* of U-shaped part 22 is opposite arbours 10, 11 where said first strand 2 abuts. Whereas, with a safety device 17 that includes two U-shaped parts 22 integral with each other, it is possible to position part 22 such that the part of first strand 2 opposite arbours 10, 11 is surrounded, for more efficient clamping. First bracelet strand 2 undergoes stress distributed over four surfaces, i.e. the two bases 22*a*, and arbours 10, 11. These two U-shaped parts can also be made integral with each other to make the assembly attractive.

Figure 8:
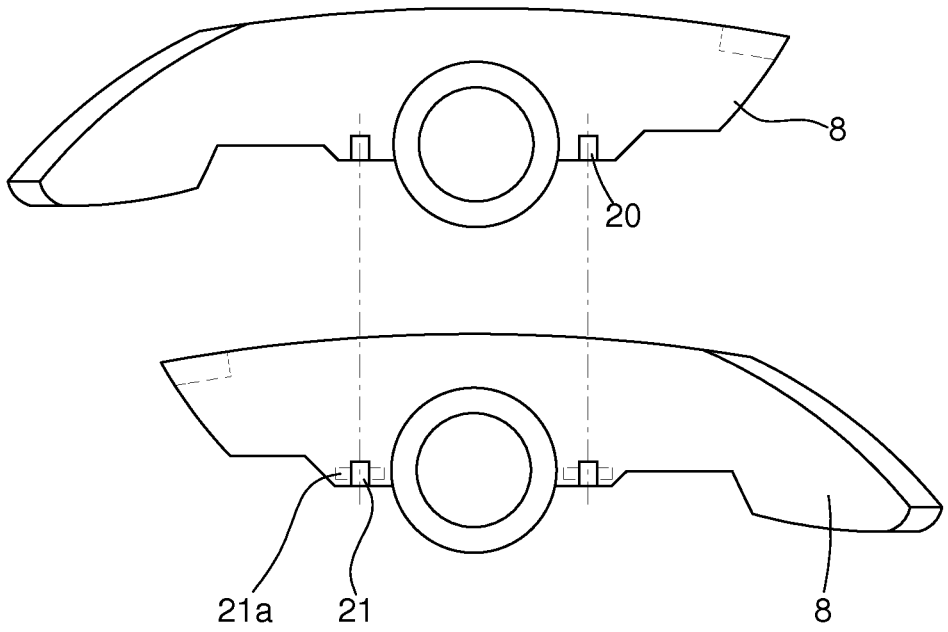
FIG. 8 shows a simplified view of the lateral arms of the clasp.

If the variant of safety device 17 with two U-shaped parts is used, it is clear that temporary attachment recesses 20 and permanent attachment recesses 21 enabling said device to be pivotably mounted on said support 4, are doubled. FIG. 8 shows, in a simplified manner, arms 8 seen from the side along arrow A of FIG. 7 for recesses 21 and along arrow A' for recesses 20. This variant also protects push-button 15 of unfolding buckle 4*a*. Indeed, in this variant, safety device 17 is arranged such that the two U-shaped parts 22 surround said push-button 15 as shown in FIGS. 1 to 4, which protects the latter from any shocks that it might be subjected to, but also from accidental opening.

In another variant, safety device 17 could be not integral with support 4. In such case, the ends of the U-shaped part(s) are only provided with hooks 18. Consequently, the recesses of each of arms 8 are temporary attachment recesses 20 in which said U-shaped parts are attached.

Of course, it is easily understood that the bracelet 1 described above is not limited simply to the characteristics described. For example, bracelet 1 may use not a clasp with an unfolding buckle 4 as above, but a conventional clasp. This clasp is arranged such that support 4 is pivotably mounted directly on second bracelet strand 3 by replacing arbour 10 with pin 7.

It will be clear that various alterations and/or improvements and/or combinations that are evident to those skilled in the art may be made to the various embodiments of the invention set out above without departing from the scope of the invention defined by the annexed claims.

The invention claimed is:

1. A strap or bracelet comprising:

(a) a first strand;

(b) a second strand; and (c) a clasp with an unfolding buckle, wherein the first strand and the second strand are connected to the clasp, wherein the clasp includes (i) a fastening device disposed to join the first strand and the second strand to each other; and (ii) a safety device that presses the first strand into clasp for better joining the first strand to the clasp wherein the unfolding buckle of the clasp is disposed so that the fastening and security devices do not need to be acted upon in order to remove the bracelet, and wherein the safety device includes a first part and a second part that are integral with each other and are disposed to clamp the first strand against the clasp.

2. The strap or bracelet according to claim 1, wherein the safety device is moveably mounted relative to the clasp enabling the strand to be temporarily detached from the clasp.

3. The strap or bracelet according to claim 2, wherein the safety device includes temporary attachment means that selectively detaches that first strand from the clasp.

4. The strap or bracelet according to claim 3, wherein the temporary attachment means includes a hook that cooperates with a recess arranged in the clasp.

5. The strap or bracelet according to claim 3, wherein the temporary attachment means is arranged on at least one end of at least one of the first part and the second part.

6. The strap or bracelet according to claim 2, wherein the safety device is moveably mounted on the clasp via permanent attachment means.

7. The strap or bracelet according to claim 6, wherein the permanent attachment means includes an eye that cooperates with a pin arranged on the clasp, and wherein the permanent attachment means is disposed so that the safety device is movable in rotation relative to the clasp.

8. The strap or bracelet according to claim 7, wherein the permanent attachment means is arranged on at least one end of at least one of the first part and the second part.

9. The strap or bracelet according to claim 1, wherein each of the first part and the second part is approximately U-shaped.

10. The strap or bracelet according to claim 1, wherein the clasp includes guide means limiting the transverse and vertical movements of the first strand when the first strand is engaged.

11. The strap or bracelet according to claim 1, wherein the fastening device includes a tongue moveably mounted on the clasp and disposed to cooperate with a hole made in the first strand.

12. The strap or bracelet according to claim 1, wherein the clasp includes an unfolding buckle that is connected to the second strand.

13. A timepiece exterior, wherein it includes a strap or bracelet according to claim 1.

14. The strap or bracelet according to claim 4, wherein the temporary attachment means is arranged on at least one end of at least one of the first part and the second part.

15. The strap or bracelet according to claim 3, wherein the safety device is moveably mounted on the clasp via permanent attachment means.

16. The strap or bracelet according to claim 4, wherein the safety device is moveably mounted on the clasp via permanent attachment means.

* * * * *